United States Patent [19]

Fennekels et al.

[11] 3,978,789

[45] Sept. 7, 1976

[54] PROCESS FOR PRINTING LONG PILED MATERIAL

[75] Inventors: Peter Fennekels, Kempen-Huls; Sieghard Helfert, Kempen; Ernst Waltmann, Krefeld, all of Germany

[73] Assignee: Girmes-Werke AG, Germany

[22] Filed: Oct. 7, 1974

[21] Appl. No.: 512,865

Related U.S. Application Data

[63] Continuation of Ser. No. 351,874, April 17, 1973, abandoned.

[30] Foreign Application Priority Data

Apr. 18, 1972 Germany ..... 2218732
May 10, 1972 Germany ..... 2222838

[52] U.S. Cl. ..... 101/211; 101/426; 427/210; 427/265

[51] Int. Cl.[2] ..... B41M 1/18

[58] Field of Search ..... 101/426, 211; 427/210, 427/265

[56] References Cited

UNITED STATES PATENTS

| | | | |
|---|---|---|---|
| 113,276 | 4/1871 | Dubois | 101/451 |
| 446,141 | 2/1891 | Dunlap | 101/425 |
| 1,607,540 | 11/1926 | Jonsson | 101/426 X |
| 1,666,031 | 4/1928 | Madden | 101/426 X |
| 1,956,197 | 4/1934 | Lines | 101/426 X |
| 1,985,245 | 12/1934 | Elliott | 101/224 |
| 2,147,653 | 2/1939 | King | 101/252 |
| 2,217,065 | 10/1940 | Magath | 101/211 X |
| 3,213,787 | 10/1965 | Miller | 101/466 |
| 3,419,413 | 12/1968 | Euforbia | 427/282 |

FOREIGN PATENTS OR APPLICATIONS

| | | | |
|---|---|---|---|
| 45 | 1915 | United Kingdom | 101/426 |
| 2,202 | 1898 | United Kingdom | 101/426 |
| 1,225,247 | 3/1971 | United Kingdom | 101/129 |

*Primary Examiner*—Clyde I. Coughenour
*Attorney, Agent, or Firm*—Mandeville and Schweitzer

[57] ABSTRACT

Process for printing long-piled material, particularly for imitating the hides of animals. In the process, in a continuous passage and in one or more steps, varying quantities of a coloring paste, according to a predetermined design, are imprinted at least on the back of the pile material while it is held under tension. After imprinting, the coloring paste is pressed into the pile material by mechanical force applied by pressure rollers. If both the front and the back of the material are to be printed, color paste is first imprinted on the front and the material then pressed, after which color paste is imprinted on the back of the material and the material pressed again.

Apparatus for performing the process comprises printing units through which the material passes under tension, and a pressing unit is provided between each two successive printing units. In one form, using a drum, each printing unit has a printing roller with an engraved surface, the depth of the engraving varying from one engraving to another according to a predetermined pattern. Extra-deep engravings are provided on the rollers printing on the back of the material. The front of the pile material is printed by means of a band which transfers color paste from a printing unit to the pile of the material, the band having a structured contact surface. As an alternative, the pile material can be printed by rotary screen printing techniques, using an endless conveyor belt instead of a drum.

3 Claims, 10 Drawing Figures

PROCESS FOR PRINTING LONG PILED MATERIAL

This is a continuation of application Ser. No. 351,874, filed Apr, 17, 1973, now abandoned.

BACKGROUND OF THE INVENTION

This invention relates to a process and apparatus for printing long-piled materials, particularly for imitating the hides of animals.

Pile materials from which imitations of hides are to be produced are usually printed solely from the pile side, with color paste. The natural hide, particularly that of a number of varieties of wild cat, nevertheless has markings which cannot be imitated by an imprint on the pile side. For example, the hide of the Siberian lynx is characterized at the base of the fur, i.e. to the skin, by dark spots of pigmentation, varying in depth and shade, some of them extending in the direction of the coarse hairs and some of them fading before the coarse hairs. The hide of the Siberian lynx also shows a completely different pattern on the back from that found on the belly. On the back the coarse hairs are of quite a different hue, their tips presenting a mixed pattern.

The hide of the ounce shows a similar but annular color scheme in the vicinity of the skin.

Hide patterns of this kind cannot be accurately imitated by the known method of printing long-piled materials solely from the pile side. A process is already known, however, for imitating these hide patterns by the methodical spraying of color solutions from nozzles onto the back of the long-piled materials. The subsequent application of vapour causes the color solution applied to the back to be drawn still more deeply into the pile fibers. It is true that this method results in a certain approach to the natural original, but it is by no means sufficiently accurate and differentiated to provide satisfactory imitations of the coats of animals.

The purpose of the invention is to enable the production of animal coat imitations from long-piled materials, with the use of one or more coloring substances, to be improved in such a way as to provide imitations far more similar to the natural original than the imitations so far known.

SUMMARY OF THE INVENTION

For the solution to this problem the invention provides a process for printing a long-piled material, particularly for the purpose of imitating animal hide, in which, in a continuous passage and in one or more steps, varying quantities of coloring agent, according to a predetermined design, are imprinted at least on the back of the pile material which is held stretched during the printing operation, after which the imprinted coloring agent is pressed into the material by mechanical force.

The coloring substance, usually a paste, is preferably pressed onto the stretched pile material, in a continuous passage, and in one or more synchronous steps, both from the back and from the front, in exact accordance with the repeats of the patterns on the two sides of the material, which differ but which belong together, after which the imprinted coloring agent is pressed into the pile material by mechanical force, so that the printing paste penetrates between the pile fibers to different depths at the different places in the design. It is true that it is also possible to vary the depth of penetration of the printing paste if the printing is carried out with different quantities of coloring substance at the different points, but in many cases it is not possible to apply sufficient coloring paste at the individual points in the course of one passage.

If coloring substance is also required on the front of the pile material, it is applied by an indirect printing operation.

Satisfactory imitations of certain natural hides, such as that of the Siberian lynx, can only be obtained if pressed onto the pile material both from the back and from the front, in one or more steps. This enables both the design of the belly and that of the back to be correctly reproduced.

It has been found that two-sided printing of long-piled materials in successive steps, in which, for example, the back of the pile material is printed first and the front then printed in a separate operation, is not feasible in practice, as the material warps when being printed, so that accurate repeats of the two designs, which belong together but are produced in different steps, cannot be obtained. According to the invention, therefore, when both the back and the front of the material are to be printed, the front and the back of the pile material are printed continuously in one single passage, color paste first of all being imprinted on the front of the pile material and the latter then being pressed, after which further color paste is applied to the back of the pile material and the latter then once again pressed. The pile material, printed in the form of a continuous web, is kept stretched at an even tension during the process, so that it can be printed with the correct repeats at the successive printing stages.

For the performance of this process the invention also provides apparatus comprising means for imprinting, in a continuous passage and in one or more steps, varying quantities of a coloring agent, according to a predetermined design, on the front and back of a pile material, means for maintaining the pile material stretched during the imprinting, and means for pressing the imprinted coloring agent into the pile material by mechanical force.

In a preferred commercial construction, the apparatus has printing units arranged in successive groups, a pressing unit being provided between each two successive groups of printing units. An apparatus of this kind enables both sides of the piled material to be printed in one continuous passage, even though in separate stages, so that the printing is carried out with the correct repeats, because the web of pile material is kept stretched at an even tension throughout the passage.

In one practical example of the apparatus of the invention, the printing units for printing the back of the pile material are provided with printing rollers with extra-deep engravings to accommodate color paste, i.e. a special depth of engraving, hitherto not customary in roller printing, for the back of the material. The engraving, at those points in the design which are intended for deep impression, approximately as far as the tips of the pile, has a depth of 1.5 mm, but the design provided on each printing roller has widely varying engraving depths, within a range of about 0.6–1.5 mm. No greater engraving depths, however, are adopted. Instead of this, if an engraving depth of 1.5 mm proves insufficient, preference is given to a number of printing operations in succession.

To obtain a succession of tints in the individual printed positions the separate parts of the engraving are provided with so-called screenings. With a printing roller of this kind it is possible, in conjuction with the subsequent treatment in the pressing unit, to print a number of animal hide patterns of the aforementioned kind, provided the pile of the material to be printed does not exceed a certain length of density. For example, the length of the individual threads of the pile amounts to about 15–20 mm and the density of the pile to about 600–900 g/m$^2$.

With very dense and correspondingly long-piled material, such as that produced on the Wildman machine, with a pile length of up to 60 mm and a pile density of 600–900 g/m$^2$, an engraving depth of 1.5 mm is insufficient. In this case a number of printing operations have to be performed one above the other in succession in one and the same place. This is done with the use of a second and if necessary a third printing roller.

A further characteristic of the invention resides in the formation of the design of the second and third printing roller. The designs of these further printing rollers do not entirely coincide with that of the preceding printing rollers. The second printing roller lacks certain parts of the design which are present on the first, while other parts of the design which belong to the first printing roller, are reproduced on the second. The third printing roller, in its turn, may lack certain parts of the design which belong to the second, so that this roller only has the parts of the design which require to be reproduced by particularly strong imprint. The parts of the design which appear on the respective printing rollers nevertheless coincide almost accurately in position, so that the parts printed by them form a continuous whole. The following result is thus achieved:

On the parts of the design which coincide the color paste is applied to the material twice, or even three times, i.e. with particular intensity, so that even a dense and long-piled covering is satisfactorily printed from the back. If the second and third printing rollers lack parts of the design which are present on the first roller, the application of color in these places is correspondingly less intensive.

It will be obvious that this system provides ample opportunity for varying the depth of impression, so that, in addition to differences in coloring, either the lower quarter, the lower half or the lower two thirds of the pile hair can be printed or colored, or even the whole of it, as far as the tips, according to the particular animal hide effect desired. This enables the hide markings of the original animal to be reproduced in all its variety.

In many cases, however, even this method does not make it possible to imitate all the features of the hide pattern, particularly as, for example, the coarse hairs on the back of the hide of the Siberian lynx have a different tint, its tips showing a noticeable mixture.

For the additional pile-side printing of the material in conjunction with the printing on the back, the preferred embodiment of the invention proposes that the color paste should be transferred to the pile side by the aid of a band. In a preceding printing unit the band takes over the intended design and tint and transfers them to the pile side of the pile material to be printed, this being preferably done before the back is printed. A characteristic feature of the imprint thus obtained is its very soft and diffuse appearance, giving the desired animal hide impression. This appearance therefore differs distinctly from an imprint obtained by direct impression with the use of a printing roller, which always results in sharp contours and raster configurations, unless a very fine and complicated screen is provided, which can soften the sharp contours.

With the subsequent pressing roller the pile side can be pressed to a certain depth. This is important, for example, in the places where the figures or parts of the design which belong to the back and those belonging to the front coincide, i.e. where superimposition of the imprints taking place on the respective sides has to be avoided, or in cases in which only the tips of the pile fibers are to be printed, so that depths of 9.0–0.7 mm have to be accurately adhered to.

In addition to actual designs, ombre stripes may be required for the pile side printing.

The band serving to transfer the color paste may consist of a coarse cotton fabric with linen binding. The band may with advantage be provided with a structured surface, in order to imitate the sometimes speckled appearance of the natural hide. The band may also consist of other suitable natural or synthetic fibers, such as linen, sisal, polyacryl nitrole, polypropylene or polyamide, or be made of fiber glass, in which case other suitable techniques may be used, such as the sewing-knitting or needle-felting technique. The band may also be produced from paper, natural rubber or artifical rubber. The suitability of the material is conditional on the stability of shape which it ensures for the band during use and on good color paste transmitting properties, and this transmission can be effected in conjunction with a structured surface, of different printed patterns, according to the type of band, i.e. according to whether it is made of fabric, felt or paper.

The invention is nevertheless not confined to the use of the printing roller technique. A further printing technique which can be adopted is rotary screen printing. It is true that this process provides a somewhat more limited range of impressions, as certain successions of tints, possible with the use of printing rollers, can no longer be obtained, but satisfactory results can nevertheless generally be obtained with screen printing likewise. If a number of round screens only partly coinciding in design are placed in succession, so that the subsequent round screens, in their turn, lack certain parts of the design, it is possible by this method likewise to obtain a printed design extending into the pile to quite a different depth, and the printing process is here again followed by a passage under a pressure roller of which the diameter is equal to that of the round screen.

The round screens, like the printing rollers, can be used for both printing the back of the material and for indirectly printing the pile side.

Among long-pile materials suitable for printing in accordance with the invention are woven, tufted, knitted or raschel-knitted long-piled materials, as well as those produced by the sewing-knitting process or other suitable techniques, the length of the separate pile threads being about 15–35 mm, although in knitted material produced on the Wildman machine it may be considerably longer. For further improvement in the appearance of the imitation hide the yarn material used for the pile will preferably be one which, in the finished material, forms a so-called two-pile yarn, i.e. the pile consists of a mixture of two types of fibre, one being shrinkable and finer and forming the lower wool, while the other is coarser and not shrinkable and forms the so-called coarse hairs.

Among the types of fibre suitable for the pile material are acryl modacryl, PVC modacryl, PVC acryl modacryl, polyester, acryl and modacryl. In the case of woven material the pile can also consist of artificial silk fibres of the most widely varying origins, such as viscol, viscose, celta and acetate, or of natural fibers, such as wool, mohair, alpaca etc.

BRIEF DESCRIPTION OF THE DRAWINGS

Embodiments of the invention will now be described by way of example, with reference to the accompanying drawings which show certain examples of the printing of pile materials in accordance with the invention, for producing imitations of animal hides.

In the drawings.

DESCRIPTION OF PREFERRED EMBODIMENTS

Figure 1:
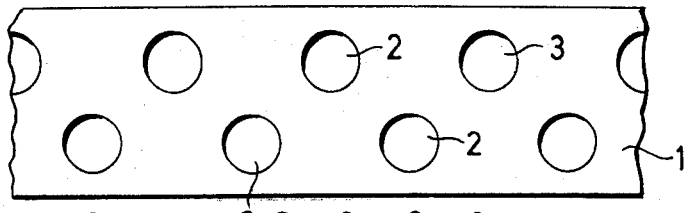
FIG. 1 is a plan view of part of a surface, opened out in one plane, of an engraved printing roller for printing the back of a pile material.
Figure 2:
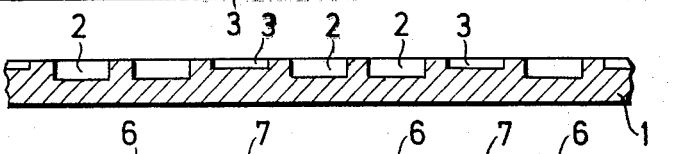
FIG. 2 is a longitudinal section through the surface of the printing roller shown in FIG. 1, this section being drawn through all the engravings shown in FIG. 1.

FIGS. 1 and 2 show merely a portion of the surface of a printing roller 1, which in the present case contains engravings 2 and 3 taking the form of circles, and as seen from FIG. 2, differing from each other in their depth. Although FIGS. 1 and 2 only show two different engravings 2 and 3 it can be easily seen that a large number of different engraving depths are possible, and also a large number of different engraving shapes are possible, according to the original to be imitated.

Figure 3:
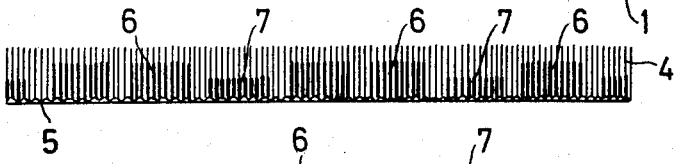
FIG. 3 is a longitudinal section through a long-piled material printed from the back with the roller shown in FIGS. 1 and 2.
Figure 4:
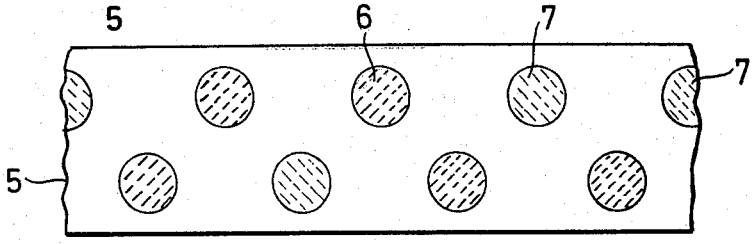
FIG. 4 is a plan view of a part of the pile material shown in FIG. 3.

From FIG. 3 it may be seen that printing paste transferred from the deeper engravings 2 has penetrated pile 4 of a pile material 5 to a greater depth than the printing paste transferred from the shallower engravings 3, so that the observer of the pile side notices a difference in the intensity of the color or tint in positions 6 and 7 on the upper side of the printed pile material, as may be seen from FIG. 4. The color paste was in this case applied to the back of the pile material 5.

Figure 5:
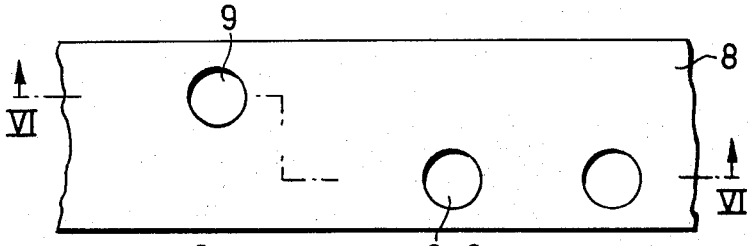
FIG. 5 is a similar view of FIG. 1, showing a second printing roller which follows that shown in FIG. 1 and which lacks certain engravings provided on the roller in FIG. 1.
Figure 6:
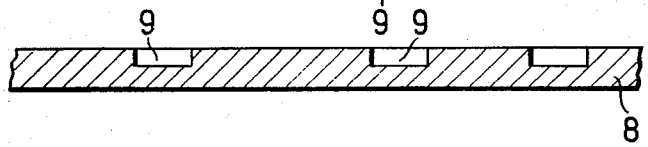
FIG. 6 is a section along the line VI'VI through the surface of the printing roller shown in FIG. 5.
Figure 7:
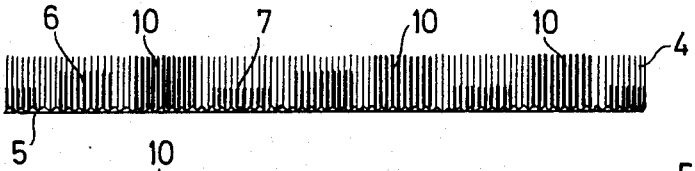
FIG. 7 is a section, similar to that shown in FIG. 3, through the pile material printed from the back a second time by means of the printing roller shown in FIGS. 5 and 6.
Figure 8:
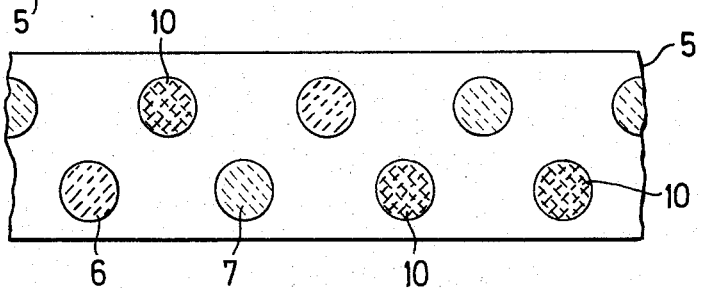
FIG. 8 is a plan view of the pile side of the pile material shown in FIG. 7.

The portion of a printing roller 8 shown in FIGS. 5 and 6 is likewise provided on its surface with engravings 9 which, as may be seen from FIG. 6, have a comparatively great depth. These engravings 9 to some extent coincide with the deeper engravings 2 of the printing roller 1, so that when the pile material 5 is again printed with the printing roller 8 further printing paste is applied to the back of the pile material in a certain portion of the already heavily printed parts 6, the color therefore penetrating practically as far as the tips of the pile in the places in question, as may be seen from FIG. 7, thereby producing still darker portions 10, while in other parts no additional coloring material is applied, so that these parts 6 and 7 remain unchanged in respect of FIG. 4.

To enable the imprint to continue as far as the tip of the pile it may sometimes be necessary for three printing rollers to be installed in succession.

The principles explained in connection with FIGS. 1–8 can be applied in the same way if round screens are used instead of printing rollers.

Figure 9:
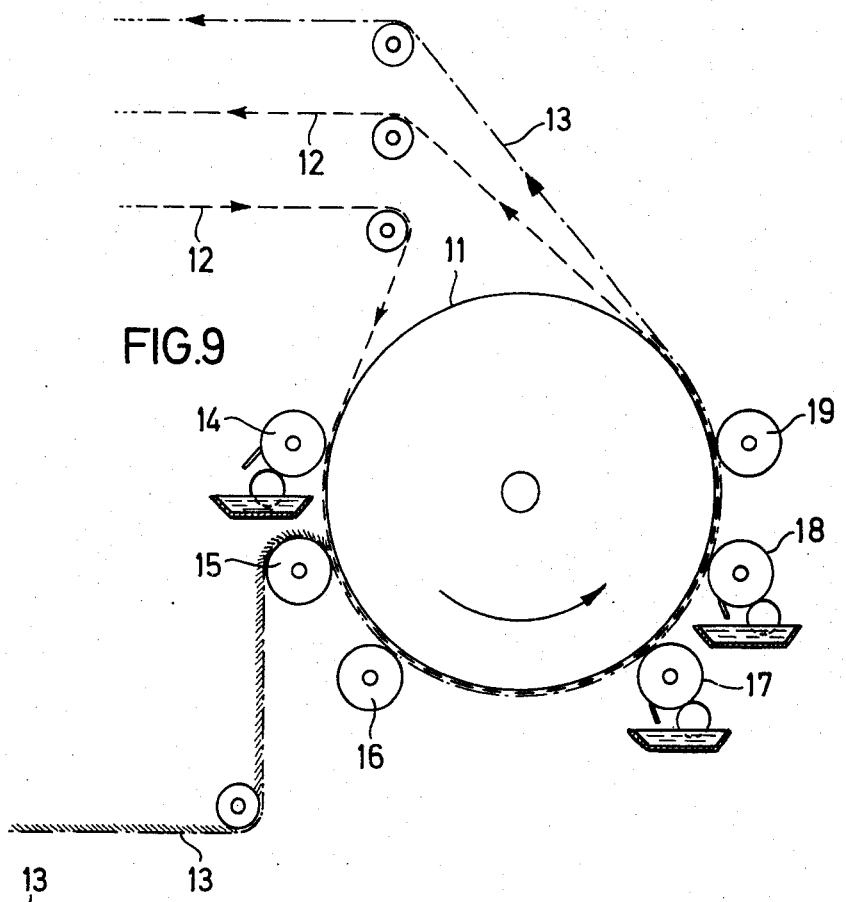
FIG. 9 is a schematic diagram of printing apparatus according to the invention, equipped with roller-type printing units.

With the device shown in FIG. 9 a pile material can be printed on both sides with the printing roller technique.

The roller printing machine shown in FIG. 9 has a drum 11 over which is guided an endless band 12 which serves to transfer color paste and which runs synchronously with the said drum 11. The band is produced with the use of natural, synthetic or glass fibres and/or from paper by the weaving, sewing-knitting, needle-felting, fleece, foil or other suitable techniques. The band has a structured surface which is produced, for example, by weaving coarse yarns in an appropriate binding or by embossing a web of paper or other material. A web 13 of long-piled material is printed by means of the roller printing machine.

Figure 10:
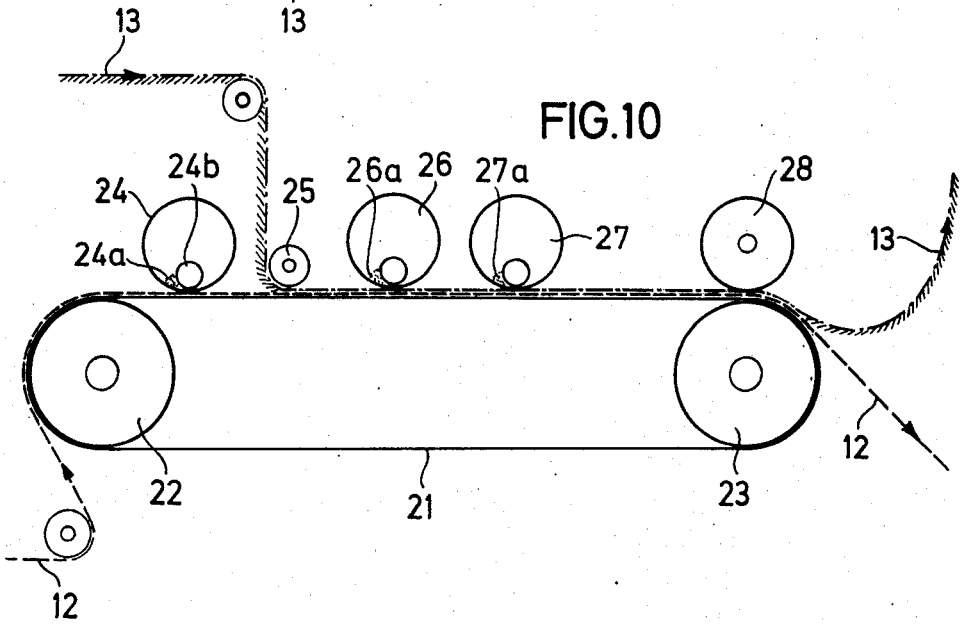
FIG. 10 is a schematic diagram of printing apparatus according to the invention, equipped with round screens.

A number of roller printing units operate together with the drum 11. The printing roller of the first roller printing unit 14 prints the outside of the band 12. The web 13 of pile material is conveyed over a deflecting roller 15 onto the printed exterior of the band 12, so that the printing paste is transferred from the said band 12 to the pile side of the pile material. A pressure roller 16 is then placed against the drum 11 and applies pressure to the web 13 of pile material which has been printed on the pile side. This is followed by further roller-type printing units 17 and 18 by which the back of the web 13 of pile material is printed according to designs coordinated with one another. Following the roller-type printing units 17 and 18 a further pressure roller 19 is placed against the drum 11. Beyond it the band 12 and the web 13 of pile material run off the surface of the drum 11, separately from each other, in which process the printed web 13 of pile material is fed to a further processing station.

in the apparatus shown in FIG. 10 the web 13 of pile material is printed by the rotary screen printing process by means of round screens 24, 26 and 27. For this purpose an endless conveyor belt 21 consisting of rubber, for example, runs over end deflecting rollers 22 and 23, an endless band 12 serving for the transfer of color paste running above the upper strand of the said conveyor belt. Immediately beyond the deflecting roller 22 a rotatably mounted round screen 24 of a known design is installed above the upper strand of the conveyor belt 21, and color paste **24*a* is pressed out of the inside of the said round screen, through the apertures with which it is provided, onto the surface of the band 12, by means of a roller 24*b*. Beyond the round screen 24 the web 13 of pile material is pressed by its pile side, and by means of a deflecting roller 25, which at the same time can serve as a pressure roller, onto the printed external surface of the band 12. Following the deflecting roller 25, further round screens 26 and 27 are rotatably mounted above the upper strand of the conveyor belt 21 and apply further printing paste 26***a* and 27*a* to the back of the web 13 of pile material. Finally, a pressure roller 28 is mounted above the deflecting roller 23 and applies further pressure to the web 13 of pile material before the latter leaves the conveyor belt 21 and the band 12 resting on the latter and is conveyed to a further processing station.

Both the printing rollers of the roller-type printing units 17 and 18 in FIG. 9 and the round screens 26 and 27 shown in FIG. 10 may be constructed, in addition to the design or ombre imprint explained in conjunction with FIGS. 1–8, at least to some extent for a complete over-print, i.e. for printing on practically the entire surface.

The material cannot slip out of position during the printing process, since it is subject to tension while running and the successive pressures are completely synchronous, so that the printed designs applied in succession are correctly coordinated with one another as regards the repeats.

The final treatment according to the invention invariably consists of the passage of the printed material under a pressure roller, which may consist of metal, plastic or rubber. The diameter of this pressure roller is preferably coordinated with the exact diameter of the preceding printing roller. The contact pressure can be varied in accordance with the quality of the material in question.

After the material has left the printing and pressing apparatus it undergoes the usual damping and rinsing for its final preparation.

We claim:

1. A process for printing pile fabric to produce fabric with the natural appearance of animal skins, said printed fabric having areas of different color intensity and shading thereon; characterized by the steps of a. maintaining a fabric web with a pile surface under longitudinal tension;

b. passing said web through a first ink applying zone defined by a plurality of spaced ink retention areas of different capacity according to the animal skin to be imitated;

c. applying the ink from said plurality of ink retention areas to the back side of said web;

d. passing said web through a pressure nip to force said applied ink upwardly through the individual piles of said web in the areas where ink was applied to the back side of said web;

e. said pressure nip forcing said applied ink into said piles from the back side of said web according to the quantity of ink applied from said ink retention areas of different capacity;

f. passing said web through a second ink applying zone defined by a plurality of spaced ink retention areas of different capacity according to the animal skin to be imitated;

g. said ink retention areas in said first and second zones registering in some cases and not in others according to the animal skin to be imitated;

h. applying the ink from said plurality of ink retention areas in said second ink applying zone to the back side of said web;

i. passing said web through a second pressure nip to force said applied ink from said second ink applying zone upwardly through the individual piles of said web in the areas where ink was applied to the back side of said web;

j. said second pressure nip forcing said applied ink into said piles from the back side of said web according to the quantity of ink applied from said ink retention areas of different capacity;

k. said second pressure nip forcing said ink from said first applying zone further into said piles in those areas of ink retention in said second ink applying zone which are in registry with said areas in said first ink applying zone; and l. repeating sequentially the application of ink to selected areas of the rear side of said web and passing said web through further pressure nips as required according to the animal skin to be imitated.

2. The process of claim 1, further characterized by the steps of a. applying ink to selected areas of the pile side of said fabric web according to the animal skin to be imitated;

b. thereafter passing said web through a preliminary pressure nip; and c. said ink application to the pile side of said web and the passage of said web through said preliminary pressure nip being prior to the passing of said web through said first ink applying zone at the rear side of said web.

3. The process of claim 1, further characterized by a. said ink retention areas in said first and second ink applying zones having a depth within the range of between about 0.6 and 1.50 millimeters.

* * * * *